US005651188A

United States Patent [19]

Swanson et al.

[11] Patent Number: 5,651,188

[45] Date of Patent: Jul. 29, 1997

[54] LINT STORAGE SYSTEM

[75] Inventors: Edward T. Swanson; Patrick J. Clark, both of St. Joseph; James J. Visin, Benton Harbor; Eric R. Kissell, Stevensville; Richard E. Fry, St. Joseph, all of Mich.

[73] Assignee: Whirlpool Corporation, Benton Harbor, Mich.

[21] Appl. No.: 700,918

[22] Filed: Aug. 21, 1996

Related U.S. Application Data

[63] Continuation-in-part of Ser. No. 425,740, Apr. 20, 1995, Pat. No. 5,560,120.

[51] Int. Cl.[6] ..... F26B 19/00

[52] U.S. Cl. ..... 34/82; 34/595; 55/295

[58] Field of Search ..... 34/82, 85, 595, 34/609; 55/481, 506, 295

[56] References Cited

U.S. PATENT DOCUMENTS

| | | | |
|---|---|---|---|
| D. 297,348 | 8/1988 | Clement | D23/365 |
| 2,776,826 | 1/1957 | Bennett et al. | 34/82 |
| 2,827,276 | 3/1958 | Racheter | 34/82 |
| 2,875,996 | 3/1959 | Hullar | 263/33 |
| 3,304,624 | 2/1967 | Czech | 34/82 |
| 3,378,934 | 4/1968 | Erickson | 34/82 |
| 4,720,925 | 1/1988 | Czech et al. | 34/82 |
| 5,042,170 | 8/1991 | Hauch et al. | 34/82 |
| 5,215,562 | 6/1993 | Kaiser | 55/294 |

*Primary Examiner*—Henry A. Bennett
*Assistant Examiner*—Dinnatia Dostor
*Attorney, Agent, or Firm*—Thomas J. Roth; Mark A. Davis

[57] ABSTRACT

A bulk lint storage system supported by a top panel of a dryer. The storage system includes a elongated lint tray connected to the top panel and having an inlet port at one end for receiving lint laden air and an outlet port. A lid is hingedly connected to the lint tray and can be positioned in an open or closed position. A lint basket having an inlet opening and a plurality of screened outlet openings is slidingly supported on support rails extending from the lid. When the lid is closed the inlet opening of the lint basket aligns with the inlet port of the lint tray wherein lint laden air is supplied into the lint basket. When the lid is positioned in an open position, the lint basket is slidingly removable from the support rails such that accumulated lint may be cleaned therefrom.

15 Claims, 4 Drawing Sheets

LINT STORAGE SYSTEM

This application is a continuation in part of application Ser. No. 08/425,740, filed Apr. 20, 1995, now U.S. Pat. No. 5,560,120 commonly assigned with the present invention.

BACKGROUND OF THE INVENTION

1. Field of the Invention

The present invention is related to a household laundry dryer and more specifically to a lint storage system for a dryer.

2. Description of the Related Art

One of the most common problems with household laundry dryers is the lint handing system. Most dryers include a removable lint screen through which lint laden air exiting the dryer is directed to pass. This screen acts as a filter and removes the lint from the exiting air to avoid undesirable lint discharge through the dryer exhaust.

Unfortunately, clogging of the lint screen can lead to poor drying performance and dangerous operating conditions. Accordingly, the operator of the dryer must manually remove the lint screen and frequently clean it, in some case after every dryer cycle. This lint screen cleaning task can become tedious and cause inconvenience to the user. As a result, attempts have been made to improve the lint handing system to provide a lint storage system such that the operator of the dryer does not have to frequently remove and clean a lint screen.

For example, U.S. Pat. No. 3,081,555 discloses a lint separator which includes an air swifter to separate lint from the exhaust air flow and a transport tube connected tangentially to the swirler to receive the separated lint and carry it to a disposable lint collection filter bag. Periodically, the lint bag is replaced with a new filter bag. While this system eliminates the need for frequent lint screen cleaning, it has the disadvantage of requiring the purchase of disposable lint storage bags. This system also does not lend itself to a simple visual system for indicating when the lint bag needs to be replaced.

U.S. Pat. No. 4,700,492 discloses a system for automatically cleaning a lint screen and transporting the removed lint to a storage chamber. Preferably, a circular lint screen has a vacuum arm rotationally movable over a lint accumulating surface of the screen. Lint from the screen is drawn into a shaped opening in the vacuum arm as it sweeps over the screen surface and is then drawn through a vacuum blower system and into a lint storage reservoir. This system is relatively complicated and costly. Moreover, it is relatively difficult to neatly remove lint from the lint storage reservoir.

SUMMARY OF THE INVENTION

It can be seen, therefore, that it would be an improvement in the art to provide a simple, relatively inexpensive system for collecting and storing lint from the exhaust air of a dryer such that the lint need only be removed from the system after a relatively large number of dryer loads have been run.

Accordingly, the present invention is directed to a lint storage system which is capable of storing lint during a dryer cycle. The lint storage system is preferably designed for use with a centrifugal type lint separation system such that only lint laden air is directed to the lint storage system.

The lint storage system of the present invention includes a lint tray supported by a top panel of a dryer. The top panel of the dryer includes an opening having a peripheral edge and the lint tray includes a top peripheral edge which engages the peripheral edge of the opening provided in the top panel. The lint tray is an elongated member and has an inlet port at one end for receiving lint laden air and an outlet port. A lid is hingedly connected to the lint tray and can be positioned in an open or closed position. A lint basket having an inlet opening and a plurality of screened outlet openings is slidingly supported on support rails extending from the lid.

The lint basket is supported within the lint tray by the lid such that when the lid is closed the inlet opening of the lint basket aligns with the inlet port of the lint tray wherein lint laden air is supplied into the lint basket. When the lid is positioned in an open position, the lint basket is slidingly removable from the support rails such that accumulated lint may be cleaned therefrom.

DESCRIPTION OF THE PREFERRED EMBODIMENT

Figure 1:
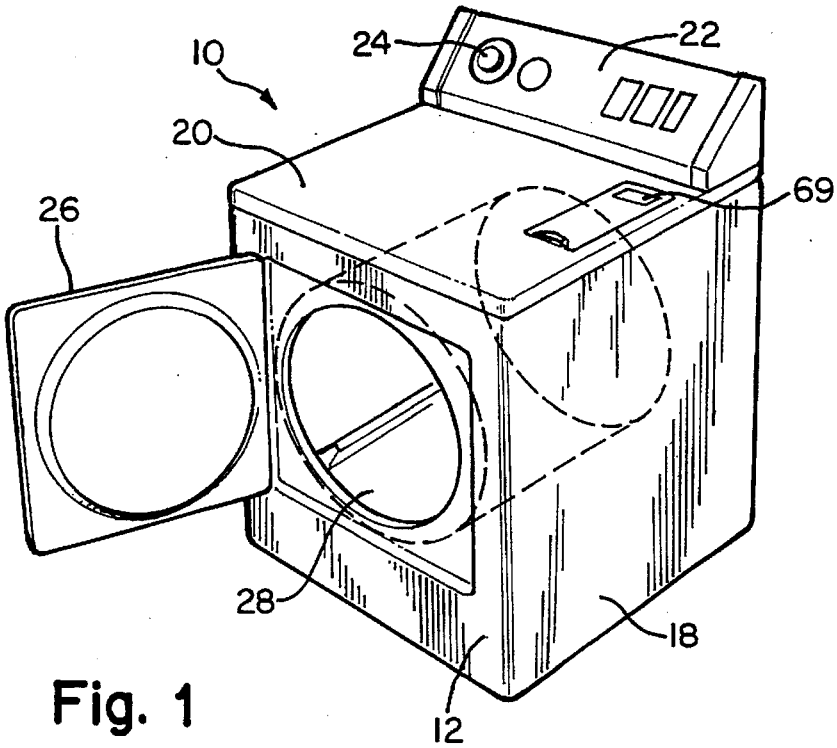
FIG. 1 is a front perspective view of a laundry dryer embodying the lint storage system of the present invention.
Figure 2:
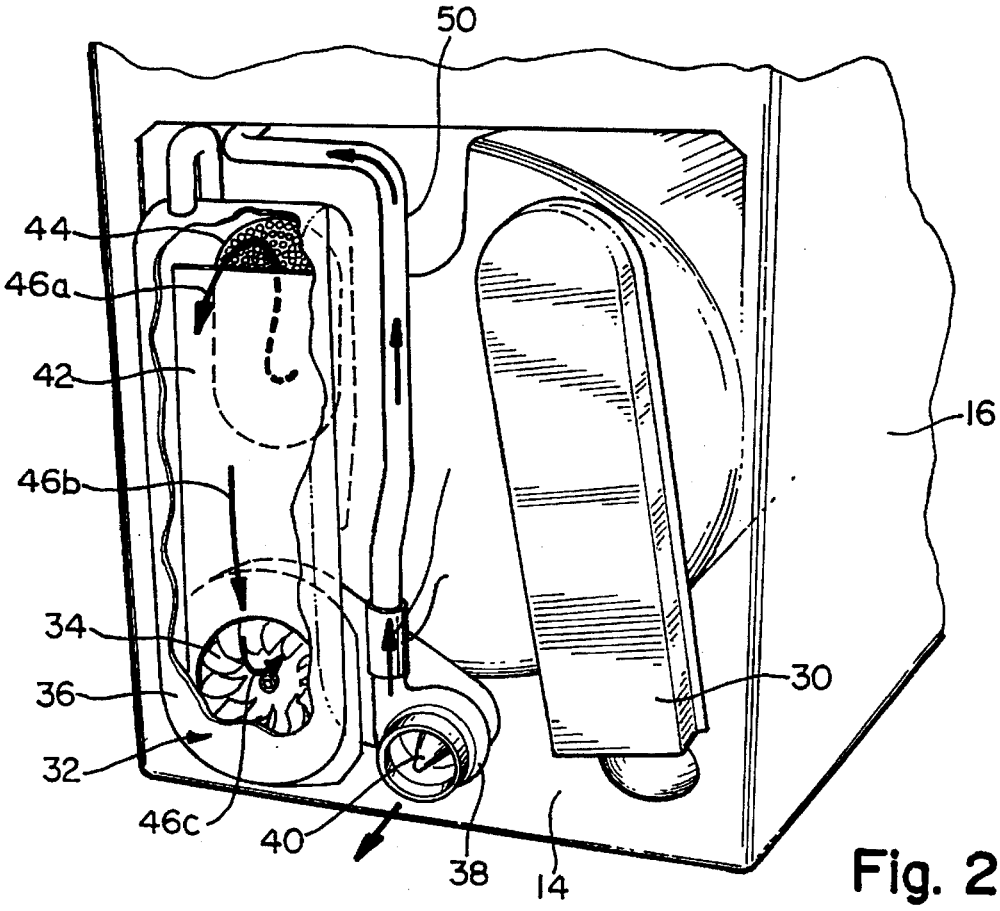
FIG. 2 is a rear perspective view of the laundry dryer of FIG. 1, partially broken away, illustrating additional details of a lint separator and a foreign objects trap in accordance with the principles of the present invention.

FIGS. 1 and 2 generally illustrate a preferred embodiment of the present invention, an improved lint handling system is provided in a household laundry dryer. Such a household laundry dryer is indicated generally at 10 and comprises a cabinet having a front wall 12, a rear wall 14 and side walls 16 and 18. A top panel 20 forms a top surface of the cabinet enclosure. Mounted at the rear of the top panel 20 is a control panel 22. Control knobs 24 are provided on the control panel 22 for operating the dryer 10. The dryer 10 also has a door 26 hingedly mounted onto the front wall 12 of the cabinet which provides access into a drum 28 in the interior of the dryer 10.

In greater detail, FIG. 2 illustrates, in a partially cut-away view, the rear wall 14 of the dryer 10. Mounted on the rear wall 14 and communicating with the drum 28 is a heater box 30. The heater box 30 generates heat necessary to dry clothing in the drum 28 of the dryer 10. A blower housing 32 surrounding a blower 34 is located near the bottom of the dryer 10. The blower housing includes a swirl chamber 36 and a lint separator referenced generally at 38. Located within the lint separator 30 is a concentrically disposed diffuser 40. A foreign object trap 42 is also provided, connected to a dryer drum air exit grill 44.

During operation, air external from the dryer is drawn into the dryer drum through the heater box 30. After circulating through the drum, the moist, lint laden air passes though the exit grill 44 into the foreign objects trap 42, as indicated by the air flow arrow 46*a*. The moist, lint laden air continues toward the bottom of the dryer as indicated by flow arrow 46*b* and is drawn into the blower housing 32 as shown by flow arrow 46*c*. The lint laden air is swirled within the blower housing 32 and is directed into the swirl chamber 36.

As the lint laden air swirls within the swirl chamber 36, centrifugal force acts upon the lint, which has more mass than the air, and causes it to separate and move outwardly in the swirling air stream. The relatively lint free air swirling in the inner portion of the swirl chamber 36 is then directed to exit the swirl chamber 36 as indicated by flow arrow 46*d* while the separated lint laden air in the outer portion of the swirl chamber 36 passes through a tangential outlet port 48 and travels through a lint transport tube 50, as shown by arrows 46*d* within the lint transport tube 50, to a lint storage system 52 (FIG. 3) of the present invention.

Figure 3:
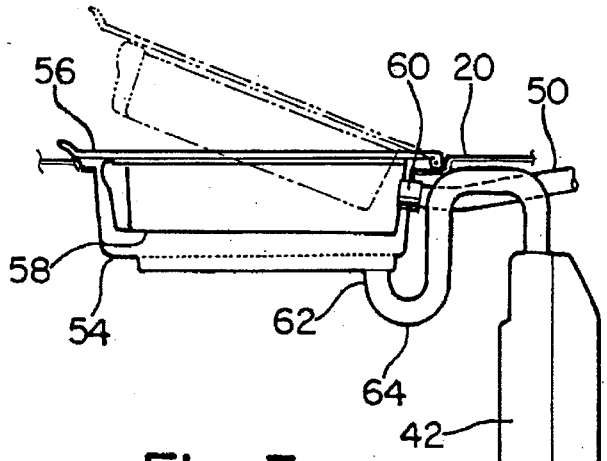
FIG. 3 is a side view of the lint storage system of the present invention.

FIG. 3 is a partial side, cut away view which illustrates the basic features of the lint storage system 52 of the present invention. A lint tray 54 is supported by the top panel 20 of the dryer. A lid 56 is hingedly connected to the lint tray 54 and slidingly supports a lint basket 58. The lid 56 can be positioned in a closed position and an open position (shown in dashed lines).

The lint tray 54 includes an air inlet port 60 and an air outlet port 62. The lint transport tube 50 connects to the air inlet port 60 for supplying lint laden air thereto. A recirculation tube 64 has a first end which connects to a fitting extending about the air outlet port 62 and has a second end which connects to the foreign objects trap 42. In this manner, as understood by one skilled in the art, air may circulate through the lint tray 54.

Figure 4:
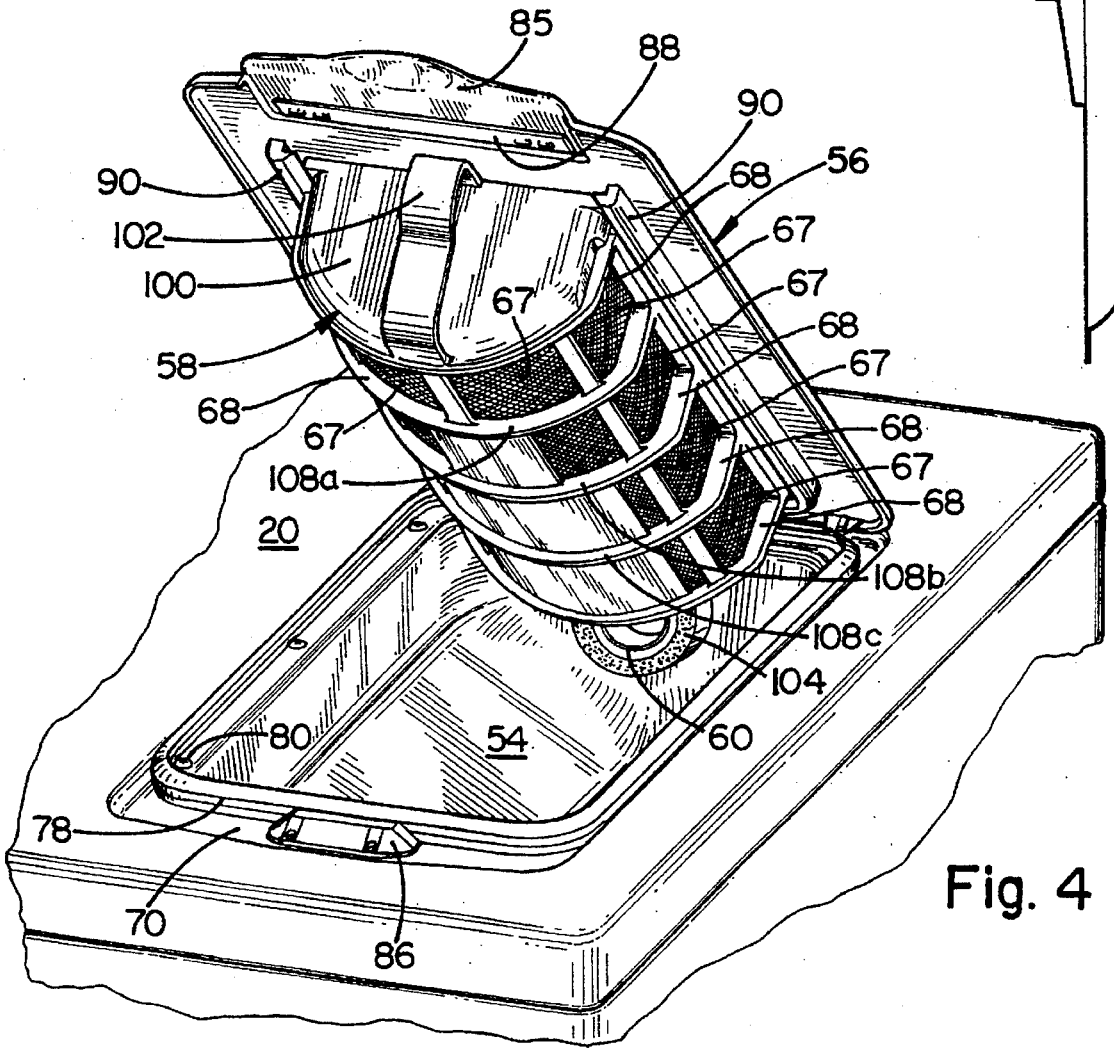
FIG. 4 is a detailed front perspective view of the lint storage system of the present invention with the lid partially open.
Figure 5:
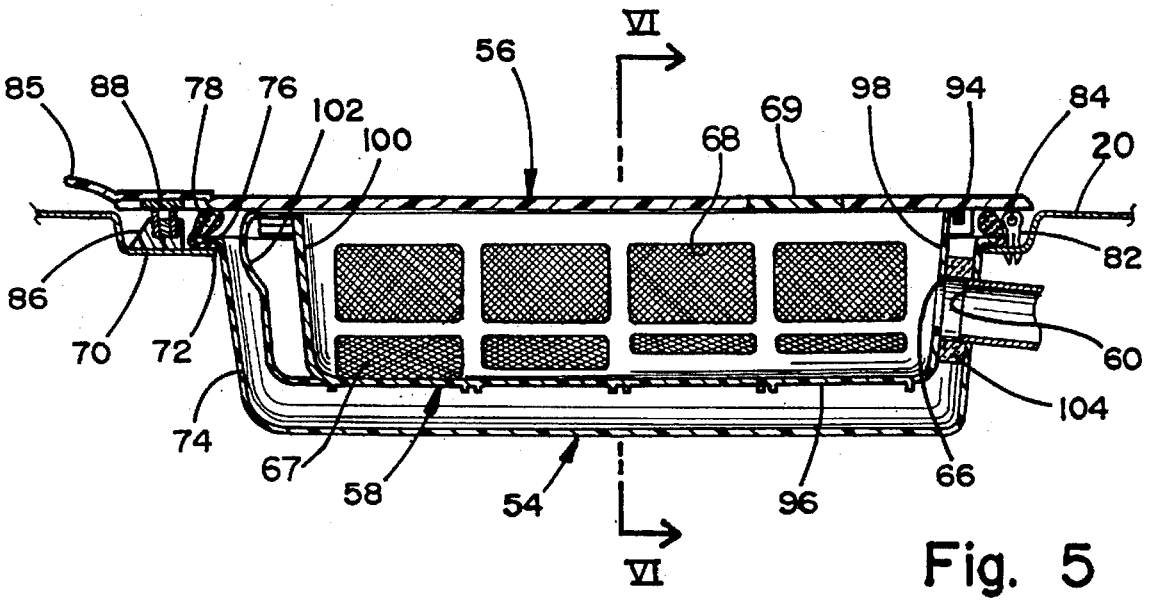
FIG. 5 is a cut-away side view of the lint storage system of the present invention in the closed position.
Figure 6:
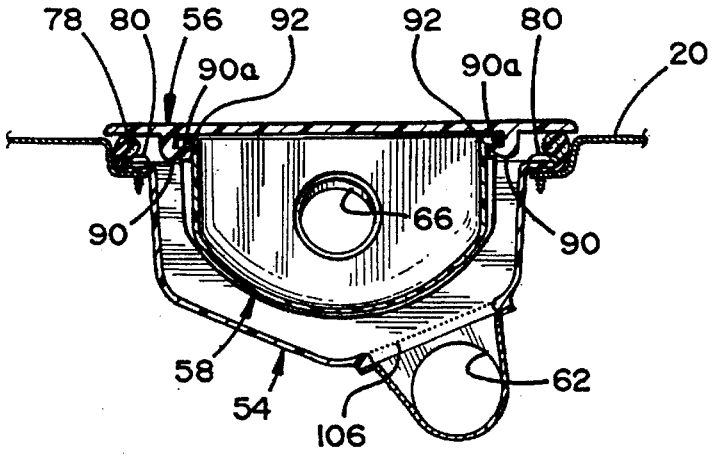
FIG. 6 is a sectional view taken along line 6—6 of FIG. 5.

Turning now to FIGS. 4, 5 and 6, details of the lint storage system of the present invention can be further understood. When the lid 56 is in its closed position, the basket 58 is supported within the tray 54 and includes an inlet opening 66 (FIG. 5) which aligns with the inlet port 60 of the lint tray 54 so that the lint laden air from the lint transport tube 50 is directed into the basket 58. The basket 58 includes a plurality of monofilament screen portions 67 supported over a plurality of outlet openings 68. Air entering the basket 58 exits through the screen portions 67 which filters the lint from the air such that lint is collected in the basket interior during the dryer operation. The lid 56 includes a window 69 (FIG. 1) that provides the user with a visual indication of when the basket 58 is full of lint and needs emptying.

As stated above, the lint tray 54 is supported by the top panel 20. In particular, the top panel 20 includes a drawn down surface portion 70 surrounding a top panel opening 72 such that the drawn down surface 70 forms the peripheral edge of the opening 72. The lint tray 54 includes a main body portion 74 which fits within the opening 72 and further includes a top flange 76 which extends above the drawn down surface 70 of the top panel 20. A resilient, elastomeric gasket 78 is disposed about the top flange 76 and has a portion which is captured between the top flange 76 and the drawn down surface 70. The tray 54 is secured to the top panel 20 by a plurality of threaded fasteners 80.

The lid 56 is hingedly connected to the top panel 20 by hinge members 82 which snap connect to the top panel 20 at one end of the top panel opening 72 and rotatably support hinge pins 84 which extend from the bottom surface of the lid 56. The lid 56 is supported by the hinge members 82 such that in a closed position (FIGS. 5 and 6), the bottom surface of the lid 56 sealingly engages the gasket 78 such that the lid 56 and the lint tray 54 form a sealed enclosure.

This sealing engagement between the lid 56 and the tray 54 is enhanced by creating a closure force for urging the lid closed. The closure force is generated by a magnet assembly 86 (FIG. 4) which is attached to the drawn down surface 70 of the top panel 20 at the end of the top panel opening opposite the hinge members 82. The magnet assembly 86 is positioned to attract a steel plate 88 which is connected to the bottom surface of the lid 56. In this manner, the lid 56 is drawn into the gasket 78 thereby ensuring a sealing engagement between the tray 54 and the lid 56.

As mentioned above, the lid 56 slidingly supports the basket 58. The lid 56 includes a pair of downwardly extending rails 90. The rails 90 include inwardly extending portions having horizontal slide surfaces 90*a* facing the bottom surface of the lid 56. The basket 58 includes side flanges 92 extending outwardly along the top side edges of the basket. The side flanges 92 are received into the gap or slot between the horizontal surface 90*a* and the bottom surface of the lid 56 such that the basket is supported by the lid. A back wall 94 extending from the lid 56 limits travel of the basket 58 along the rails 90. The basket is an elongated body generally having a U-shaped cross section and an open top portion. When the basket 58 is slidingly joined to the lid 56, the lid 56 acts as a lid or top wall of the basket 58 such that the basket forms an enclosure for receiving lint.

As can be readily understood by one skilled in the art, the basket 58 can be removed from and engaged with the lid 56 when the lid 56 is in an open position. A handle 102 extending outwardly from the second end wall 100 of the basket 58 facilitates removal, cleaning and replacement of the basket by the operator. When the lid 56, supporting the basket 58, is rotated from an open position to a closed position, the basket 58 is rotated down into the cavity formed by the lint tray 54. As the basket 58 is rotated into the lint tray cavity, the first end wall 98 of the basket 58 engages an annular seal member 104 disposed about the air inlet port 60. When the lid 56 is completely closed, the basket 58 is sized such that the handle 102 engages the main body 74 of the tray 54 and moves the end wall 98 into the annular seal 104 such that the seal 104 is compressed.

In this fashion, the tray inlet port 68*a* and the basket inlet opening are sealingly connected such that lint traveling through the lint transport tube 50 is directed into the enclosure formed by the basket 58 and the lid 56. The air entering the basket enclosure is then forced through the screen portions 67 extending over the basket outlet openings 68 such that the lint is filtered out of the air and captured in the basket 58. The filtered air travels between the outer surface of the basket 58 and the tray 54 and is drawn behind a bottom plate 106 (FIG. 6) of the tray 54 and out through the outlet port 62.

Figure 7A:
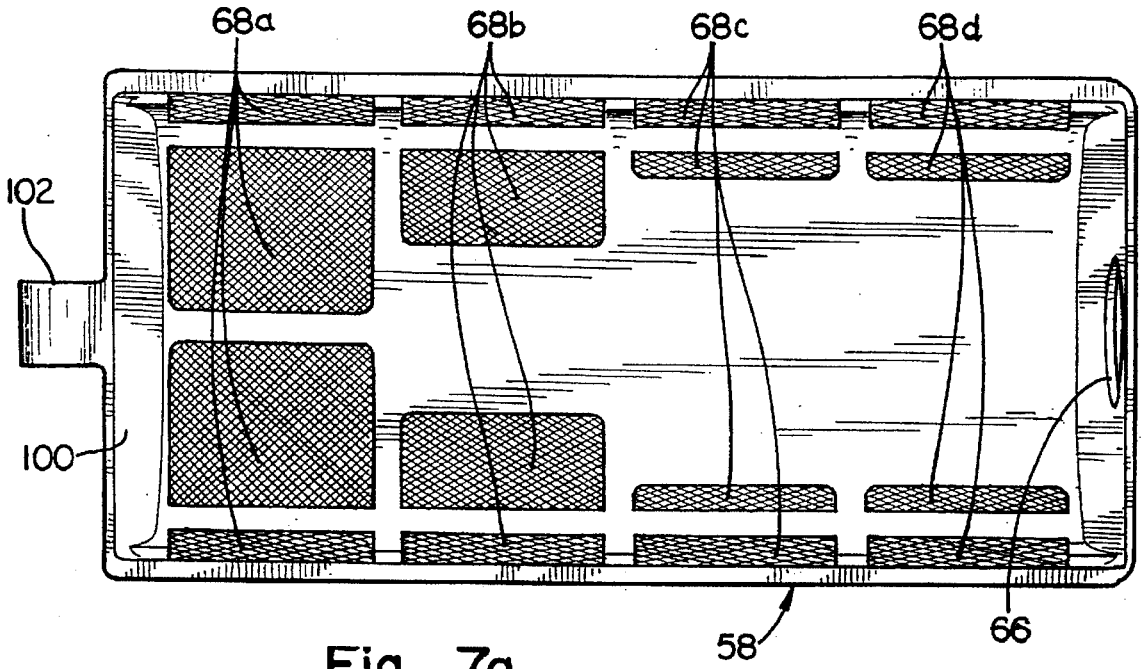
FIG. 7*a* is a top view of the lint collection basket of the present invention.
Figure 7B:
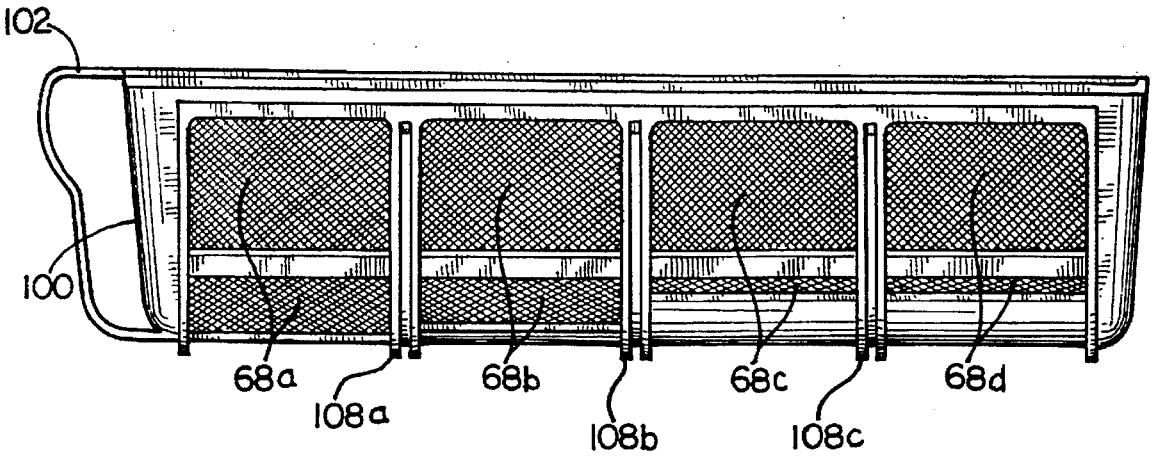
FIG. 7*b* is a side view of the lint collection basket of the present invention.

Turning now to FIGS. 7*a* and 7*b*, details of the basket 58 can be clearly seen. The basket comprises a U-shaped filter wall 96, a first end wall 98 and a second end wall 100. The inlet opening 66 is disposed on the first end wall 98 and the outlet openings 68 are disposed along the U-shaped filter wall 96. The U-shaped filter wall 96 of the basket 56 is divided into four equal portions by support ribs 108*a*, 108*b* and 108*c*. The screened outlet openings 68 are provided between the end walls 98 and 100 and the ribs 108*a*, 108*b*, 108*c* and 108*d*. More particularly, the outlet openings are oriented and sized such that outlet openings 68*a* cover substantially the entire surface area between the second end wall 100 and the support rib 108*a*. Between ribs 108*a* and 108*b*, outlet openings 68*b* cover less surface area then outlet openings 68*a*. Finally, between ribs 108*b* and 108*c* and between rib 108*c* and the first end wall 98, outlet openings 68*c* and 68*d* cover less surface area than covered by outlet openings 68*b*.

In this fashion, between the first end wall 98 and the second end wall 100 successively greater portions of the surface area of the U-shaped filter wall of the basket 58 are covered by the outlet openings 68*a*, 68*b*, 68*c* and 68*d*. Accordingly, a greater quantity of air introduced into the basket 58 flows through the openings 68*a* than through 68*b*. Likewise, a greater quantity of air is filtered through openings 68*b* than through 68*c* or 68*d*. This configuration of the screened outlet openings 68 results in proportioning the air flow out of the basket such that a majority of the air exits through the outlet openings 68*a* and 68*b* near the second end wall 100. Although the outlet openings 68*a*–68*d* are illustrated as being reduced in a stepped fashion, any type of reduction, including a continuous reduction, is suitable. The rate of the reduction will vary depending on the size and shape of the basket 58 and the air flow rate.

By proportioning the air flow through the basket in this manner, a greater amount of lint is filtered near the second end wall 100 than near the first end wall 98. This results in a lint accumulation within the basket 58 in a linear fashion such that the lint builds up near the second end wall 100 first and then grows toward the first end wall 98 during successive dryer operations. This linear lint collection results in a lint "loaf" forming in the basket. The lint basket 58 is supported by the lid 56 such that the window 69 is disposed over the lint basket near the first end wall 98. Accordingly, when the lint loaf is visible to the operator through window 69, the lint basket 58 is substantially full of lint. In this manner, the entire capacity of the basket 58 is utilized before an indication or signal is made to the operator to clean the lint basket resulting in an optimum cleaning frequency of the lint basket.

In operation, as the dryer is run, the lint is separated and directed into the basket 58 where it is deposited or collected in a linear fashion corresponding to the size of the openings 68*a*–68*d*. In other words, most of the lint initially collects beginning at end wall 100 and moves towards the wall with the inlet opening 66. When the lint has collected to the size where the leading edge of the loaf is visible in the window 69, the user can visually see that it is time to clean the basket 58.

It can be seen, therefore, that the present invention provides a unique and advantageous configuration for lint collection system in a laundry dryer. Although the present invention has been described with reference to a specific embodiment, those of skill in the Art will recognize that changes may be made thereto without departing from the scope and spirit of the invention as set forth in the appended claims.

We claim:

1. A lint storage system for a laundry dryer having a top panel, the lint storage system comprising:

a lint tray, the tray being an elongated member and having an inlet port at one end for receiving lint laden air and an outlet port;

a lint basket having an inlet opening and a screened outlet opening; and a lid hingedly connected to the lint tray and having support rails for supporting the lint basket within the lint tray such that the inlet opening of the lint basket aligns with the inlet port of the lint tray wherein lint laden air is supplied into the lint basket, the lint basket being slidingly removable from the support rails when the lid is positioned in an open position.

2. The lint storage system according to claim 1, further wherein:

the lint tray includes a top peripheral edge; and a gasket is provided about the top peripheral edge of the lint tray for sealing the interface between the lid and the lint tray when the lid is closed.

3. The lint storage system according to claim 1, further comprising:

means for creating a lid closure force.

4. The lint storage system according to claim 1, further wherein:

the laundry dryer includes a top panel; and the lint tray is supported by the top panel of the dryer.

5. The lint storage system according to claim 4, further comprising:

a hinge pin extending from the bottom surface of the lid; and a hinge element rotatably receiving the hinge pin and having means for connecting to the top panel.

6. The lint storage system according to claim 4, further wherein:

the top panel of the dryer includes an opening having a peripheral edge;

the lint tray includes a top peripheral edge which engages the peripheral edge of the opening provided in the top panel; and a gasket is provided about the top peripheral edge of the lint tray partially between the top panel and the lint tray for sealing the interface between the lint tray and the top panel and the interface between the lid and the lint tray when the lid is closed.

7. The lint storage system according to claim 4, further comprising:

a magnet attached to the top panel adjacent the lint tray; and a strike plate attached to the lid such that when the lid is in a closed position the strike plate is attracted to the magnet for creating a closure force.

8. The lint storage system according to claim 1, further wherein the lint basket forms an elongated enclosure having an open top and longitudinally extending top side edges, each side edge having an outwardly extending support rib wherein the support rails of the lid receive the support ribs such that the basket may be slidingly supported on the lid.

9. The lint storage system according to claim 8, further wherein:

the lint tray has an end wall opposite the inlet port and further has a seal element disposed about the inlet opening; and the lint basket has a handle, wherein when the basket is slidingly supported by the lid rails and the lid is in the closed position, the basket handle interferes with the lint tray end wall such that the lint basket is urged against the seal element disposed about the inlet port.

10. A lint storage system for a laundry dryer, comprising:

a top panel forming a top surface of the laundry dryer, the top panel having an opening;

a lint tray positioned within the top panel opening and mounted to the top panel, the tray being an elongated member and having an inlet port at one end for receiving lint laden air and an outlet port;

a lint basket having an inlet opening and a plurality of screened outlet opening;

a lid hingedly connected to the lint tray and having means for supporting the lint basket within the lint tray such that the inlet opening of the lint basket aligns with the inlet port of the lint tray wherein lint laden air is supplied into the lint basket, the lint basket being slidingly removable from the support rails when the lid is positioned in an open position; and a window disposed on the lid for viewing the status of lint accumulation within the lint basket.

11. The lint storage system according to claim 10, further comprising:

means for sealing the interface between the lint tray and the top panel.

12. The lint storage system according to claim 10, further wherein:

the lint basket forms an elongated enclosure having an open top and longitudinally extending top side edges, each side end having an outwardly extending support rib; and the lid has a pair of support rails for receiving the support ribs such that the lint basket is slidingly received supported by the lid.

13. The lint storage system according to claim 10, further comprising:

a magnet attached to the top panel adjacent the lint tray; and a strike plate attached to the lid such that when the lid is in a closed position the strike plate is attracted to the magnet for creating a closure force.

14. The lint storage system according to claim 10, further comprising means for sealingly connecting the inlet opening of the lint basket to the inlet port of the lint tray.

15. The lint storage system according to claim 14, further wherein:

the lint tray has an end wall opposite the inlet port and further has a seal element disposed about the inlet opening; and the lint basket has a handle, wherein when the basket is slidingly supported by the lid rails and the lid is in the closed position, the basket handle interferes with the lint tray end wall such that the lint basket is urged against the seal element disposed about the inlet port.

* * * * *